United States Patent [19]

Mostul

[11] Patent Number: 4,461,052

[45] Date of Patent: Jul. 24, 1984

[54] SCRUBBING BRUSH, RINSE AND SWEEPING EQUIPMENT

[76] Inventor: Thomas A. Mostul, 10567 SW. 63rd Dr., Portland, Oreg. 97219

[21] Appl. No.: 423,675

[22] Filed: Sep. 27, 1982

[51] Int. Cl.[3] ..... A46B 13/06

[52] U.S. Cl. ..... 15/29; 15/24; 239/287; 239/446; 137/625.13

[58] Field of Search ..... 15/24, 29, 50 R, 97 R, 15/98; 239/287, 444, 445, 446, 448

[56] References Cited

U.S. PATENT DOCUMENTS

| | | | |
|---|---|---|---|
| 3,799,451 | 3/1974 | Kollmai | 239/446 |
| 4,151,624 | 5/1979 | Montalvo | 15/97 R |
| 4,279,051 | 7/1981 | Malcolm | 15/29 |
| 4,374,444 | 2/1983 | Zhadanov | 15/29 |

*Primary Examiner*—Edward L. Roberts
*Attorney, Agent, or Firm*—Lee R. Schermerhorn

[57] ABSTRACT

A hand operated combination handle and control valve assembly applicable to each of three related cleaning devices. The valve, when attached to a standard pressurized water hose, controls the pressure flow as desired; such as off, pressure to a first outlet port, pressure to both the first and second outlet ports, and finally, pressure to only the second outlet port. A first scrubbing device consists of the handle/valve attached to a pair of water passage tubes assembled to receive pressurized water to impart rotational motion to a turbine operated, planetary gear reduction driven scrubbing brush and also to rinse the soap residue of the scrubbing operation. A second scrubbing device consists of the handle/valve attached directly to a housing which directs pressurized water to a nozzle to wet or rinse an object and also through an inclined orifice to impart rotational motion to a water turbine attached to a central shaft designed to receive a scrubbing brush, such as a bottle brush. The third device consists of the handle/-valve attached to a pair of inclined water passage tubes having at their lower ends a caster and nozzles to sweep a surface, such as a driveway.

10 Claims, 12 Drawing Figures

100
102
104
108
110
112
114
116
118
120
122
126
128
130
103
106
12
14
16
18
20
22
24
26
28
30
32
34
40
42
44
46
60
8
9

200
202
208
216
214
206
212
210
204
12
22
26
28
60
14
24
18
16
100
104
102
114
116
118
120
112
122
130
126
128
124
10
130

SCRUBBING BRUSH, RINSE AND SWEEPING EQUIPMENT

BACKGROUND OF THE INVENTION

This invention relates to scrubbing and sweeping devices driven by a pressurized water supply from an ordinary garden hose.

There is room for improvement in the various types of scrubbing brushes heretofore proposed. Existing scrubbing brushes are either of the simple handle with affixed stationary brush which require manual manipulation and are too small for efficient and satisfactory cleaning or are designed with rotating brushes that are too small and not powerfully driven or too complicated to be practical.

It is thought that existing prior art brush devices do not make use of a water driven turbine driving a simple planetary gear reduction system to impart the necessary strong rotary movement to a scrubbing brush.

SUMMARY OF THE INVENTION

The present invention relates to scrubbing and sweeping devices driven by a pressurized water supply from an ordinary garden hose, and more particularly, to a hand-manipulated valve and disc-shaped planetary gear driven, rotating, scrubbing brush unit having integral means for dispensing soap and integral means for rinsing. Another device utilizes the hand manipulated valve with a turbine driven bottle shaped scrubbing brush unit having integral means for wetting or rinsing. Yet another devices utilizes the hand-manipulated valve with interconnecting tubes having their lower ends clamped together and having an attached swiveling type caster to establish a predetermined relationship, to a surface being cleaned, of nozzles affixed to the ends of the tubes.

The present invention is particularly useful in adapting the common source of pressurized water supply to power scrubbing and sweeping devices, as well as having integral rinsing or multiple sweeping alternatives.

The handle/valve of the devices allows proper operator control for efficient cleaning, rinsing and sweeping.

All points of operation that require a pressurized flow of water have been designed to perform at optimum velocity, but at the same time, require minimal volume. In this manner, efficiency of operation is maintained while yet conserving water (for instance, using considerably less amounts of water than used by most people to wash a car).

The invention will be better understood and additional objects and advantages will become apparent from the following detailed description of the preferred embodiments illustrated in the accompanying drawings. Various changes may be made in the details of construction, and all such modifications within the scope of the appended claims are included in the invention.

DETAILED DESCRIPTION OF THE PREFERRED EMBODIMENTS

This disclosure includes a four-way handle/valve adaptable to each of three automobile related inventions. The primary device is a hand-held washing brush. This brush differs from existing water hose attachments in that it uses a water powered planetary gear reduction system and includes means for rinsing.

In the rotary wash brush, water enters the handle where the lever operated valve controls flow; such as off, wash, wash and rinse and rinse. By depressing the lever to a first position, water is diverted to a first tube through an in-line soap dispenser and on to operate a turbine and planetary gear driven brush. Further depression of the valve lever directs water to a second tube to squirt out a nozzle and rinse the surface being cleaned.

A second device is made to effectively clean wire and magnesium type wheels. This is an impeller driven, bottle shaped brush, using the same handle/valve.

The third device using the same handle/valve includes two tubes with nozzles to both sweep and squirt off surfaces, such as driveways.

Figure 1:
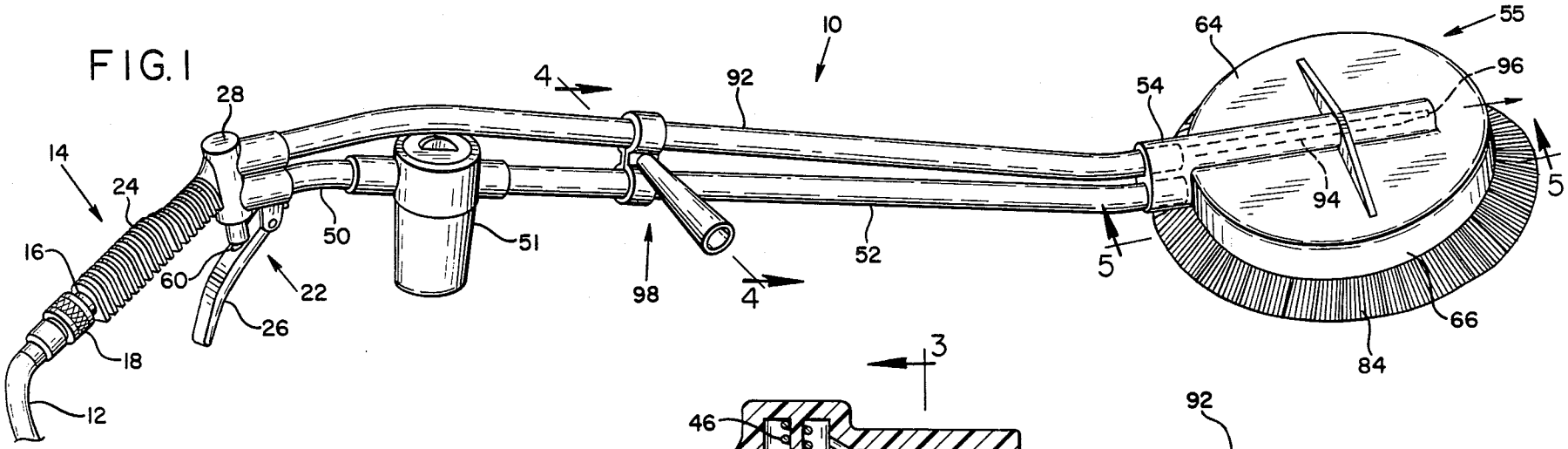
FIG. 1 is a perspective view of the handle/valve assembled through tubes to a soap dispenser and wash brush.

Referring first to the rotary wash brush assembly 10 (See FIG. 1), a hose 12 is attached to the plastic handle 14 having the male portion 16 of a quick connect/disconnect shut off assembly 18 integrally attached to its inlet side to communicate with a central passage 20 (See FIG. 2) leading to a hand operated valve mechanism 22. Handle 14 has lateral rings 24 to provide a positive grip, as well as a way to reduce mass in the plastic molding process.

Valve 22 includes a valve actuating lever 26 which is pivotally attached to the valve body 28 by depending ears 30 provided with bores 32 to receive outward extending pins 34 attached to lever 26. Lever 26 is assembled to valve body 28 by insertion between ears 30. Ramps 36 on pins 34 force ears 30 to spread until aligned with bores 32 when spring action of the ears entrap the pins 34. High sides 38 of pins 34 provide the pivot of lever 26. Protrusion 40 provides a stop for lever 26 against valve body 28, and also retains a valve spool 42 against upper surface 44 of lever 26.

As shown, depressing lever 26 also depresses valve spool 42, and valve return spring 46 to make reduced neck portion 47 connect central passage 20 with outlet orifice 48. This will first allow water to pass through orifice 48, where the tube 50, attached to valve body 28, directs water through an in-line soap dispenser 51 and then through tube 52, which is attached to a boss 54 on wash brush 55, and on through a slanted orifice 56 to operate a turbine 58 in FIGS. 5 and 6.

Turbine 58 is rotatably mounted on center member 62 in an inverted cup like body 64 open at its bottom 65 and containing a peripheral guard 66. High pressure water passing through slanted orifice 56 strikes turbine vanes 68 which impart rotational motion to the turbine 58, which in turn rotates attached pinion sun gear 70. Pinion sun gear 70 is in constant mesh with a planetary gear 72, which is also in constant mesh with ring gear 74. Planetary gear 72 is free to rotate on a post 76 which is anchored (fixedly) to the squared end 78 of the center member 62 by an arm 80.

Ring gear 74 rotates on a boss 82 of fixed arm 80. Approximately 6 turns of turbine 58 will result in one turn of ring gear 74, which has brush 84 keyed to it at lug 86 to produce reduced rotational motion with relatively high torque. The entire assembly is held together by a single flanged screw 88 which allows easy removal and installation of the brush element 84 for cleaning, repair or change.

Figure 2:
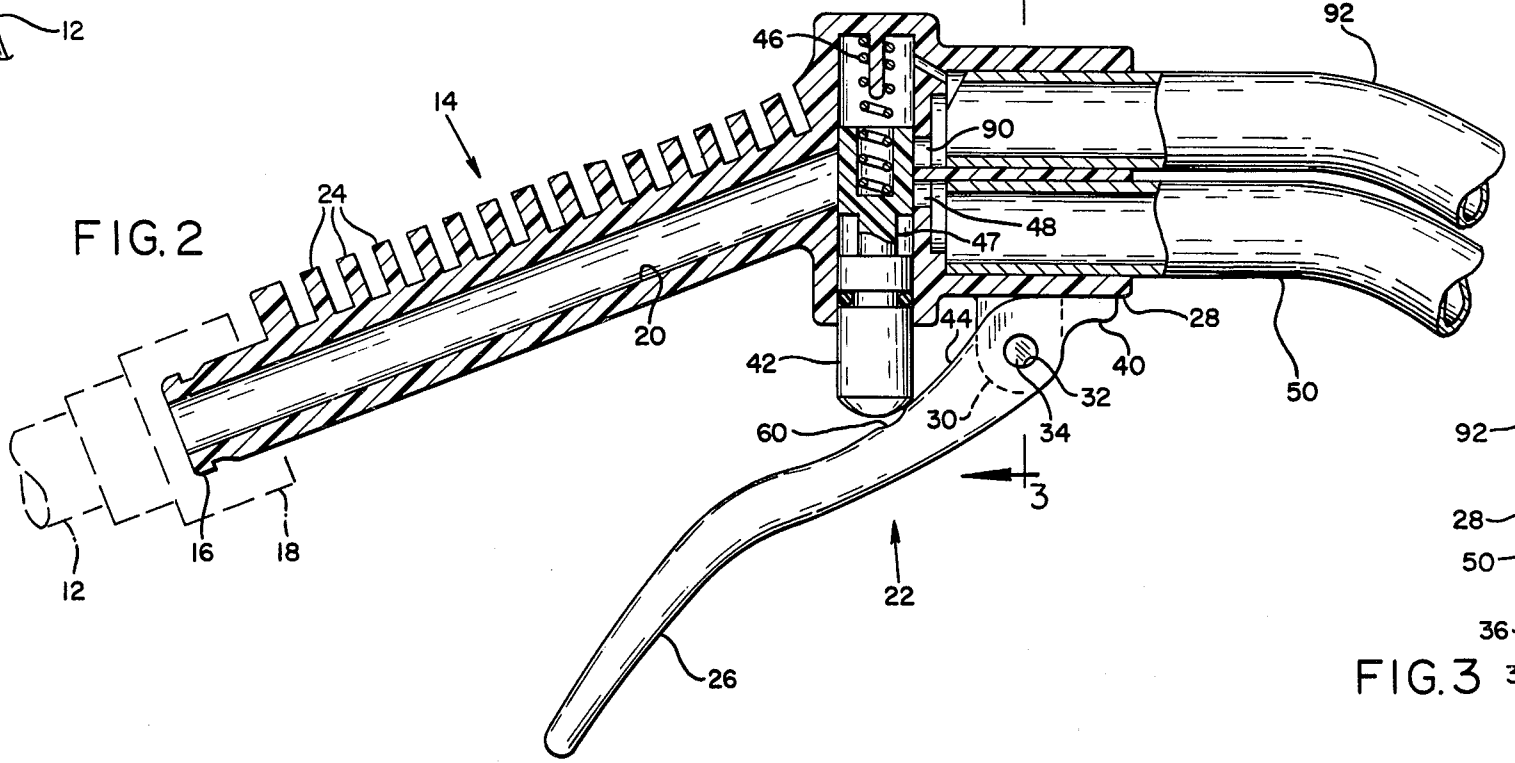
FIG. 2 is a vertical section view of the handle/valve shown in FIG. 1.
Figure 3:
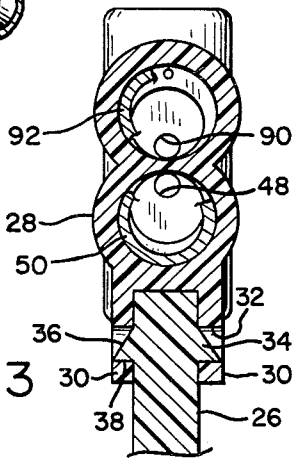
FIG. 3 is a vertical section view of the lever and tube attachment to the valve taken on Line 3—3 of FIG. 2.

A slight depression in the lever 26 at 60 gives a detent position of lever 26 when in the wash mode just described (See FIG. 2).

In the wash mode the soapy water discharged from turbine 58 is applied by brush 84 to the surface being cleaned.

Referring back to the handle 14, further depression of the lever 26 will cause reduced neck portion 47 of spool 42 to align with a second orifice 90 and stop flow to orifice 56. This mode of operation is for soaking or rinsing where water pressure is directed through tube 92, and brush body passage 94 to nozzle 96.

Depressing lever 26 to an intermediate position will supply water to both outlet orifices 48 and 90, if desired.

A handle and clamp assembly 98 (See FIG. 1) is used to stabilize tubes 52 and 92 and also to allow the operator a means to manipulate the brush assembly 10.

The second device 100 (See FIGS. 7, 8 and 9), when attached to a hose 12 by a quick connect/disconnect shut-off assembly 18, using the same handle 14 and valve 22, is made to clean wire and magnesium type wheels. The handle 14 and valve 22, as previously described, are attached directly to a guard type body 102 by lugs 103. Handle 104 is attached to body 102 for manipulating the brush. Once again, depression of valve lever 26 will first allow water to be directed to a bore 106 and out a nozzle 108 to soak or rinse the wheel being cleaned.

Further depression of lever 26, to the second valve position, directs high pressure water through an inclined orifice 110 (See FIG. 7) to impart rotational motion to the high speed turbine 112 which is directly connected by a central boss 114 to a shaft 116. Shaft 116 is rotatably mounted in bearing boss 118 which is supportly mounted to the body 102 by gussets 120. Rotation of turbine 112 causes shaft 116 to rotate the attached brush 122.

Figures 9, 10, 11, 12:
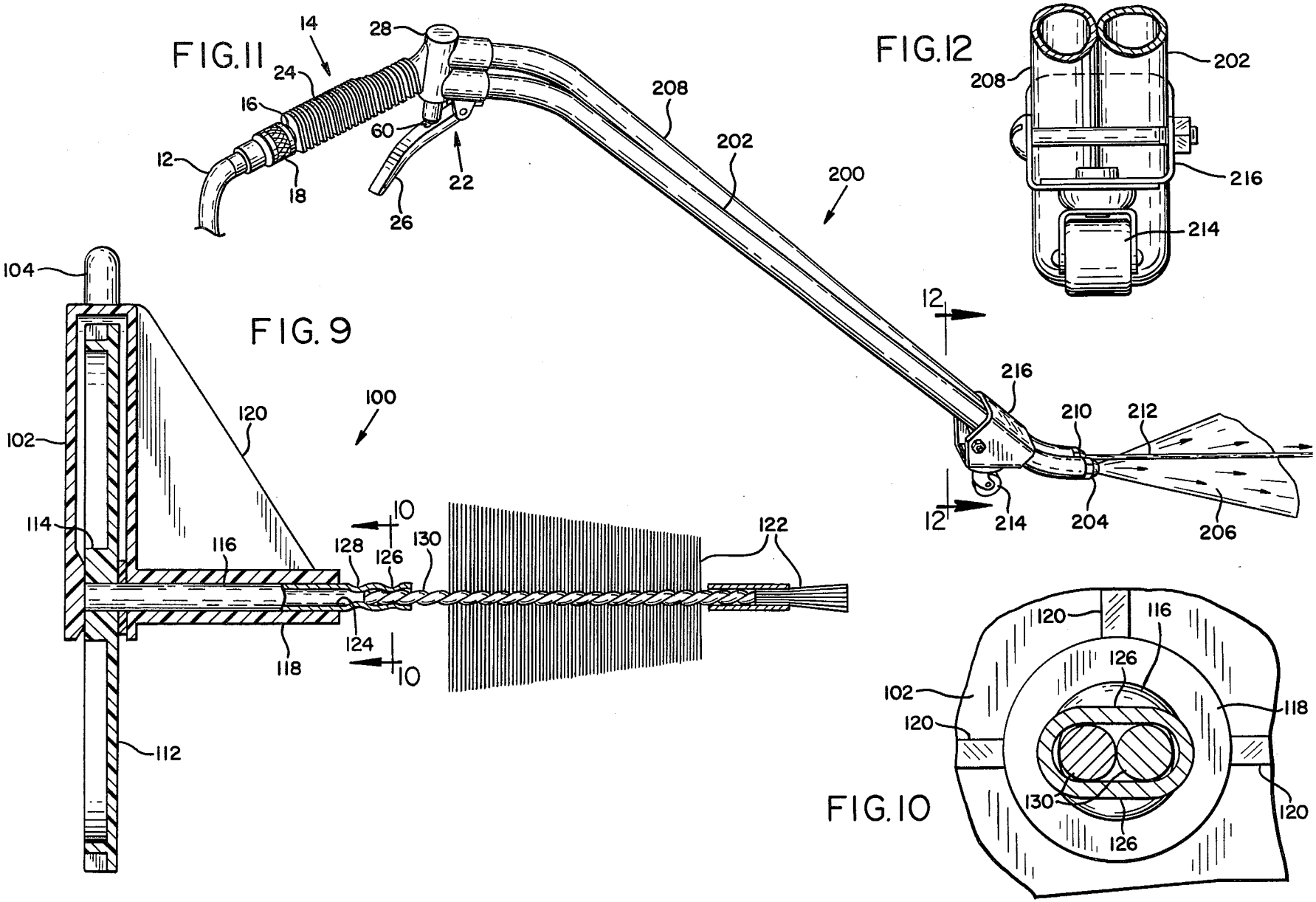
FIG. 9 is a vertical section view of the wheel washing brush taken on Line 9—9 of FIG. 7.
FIG. 10 is a transverse vertical section view showing the brush attachment taken on Line 10—10 of FIG. 9.
FIG. 11 is a perspective view of the handle/valve assembled through tubes to a wheel and nozzles for sweeping.
FIG. 12 is a vertical view showing the rear of the wheel taken on Line 12—12 of FIG. 11.

Shaft 116 has a bore 124 and depressions 126 and 128 to receive the twisted end 130 of brush 122 (see FIGS. 9 and 10). When brush 122 is inserted into shaft bore 124 slight counter clockwise rotation of the twisted brush end 130 will thread between depressions 126 and impinge upon depressions 128. The brush 122 is relatively small in diameter and does not require the high torque required by the large diameter rotary brush 84.

Figure 5:
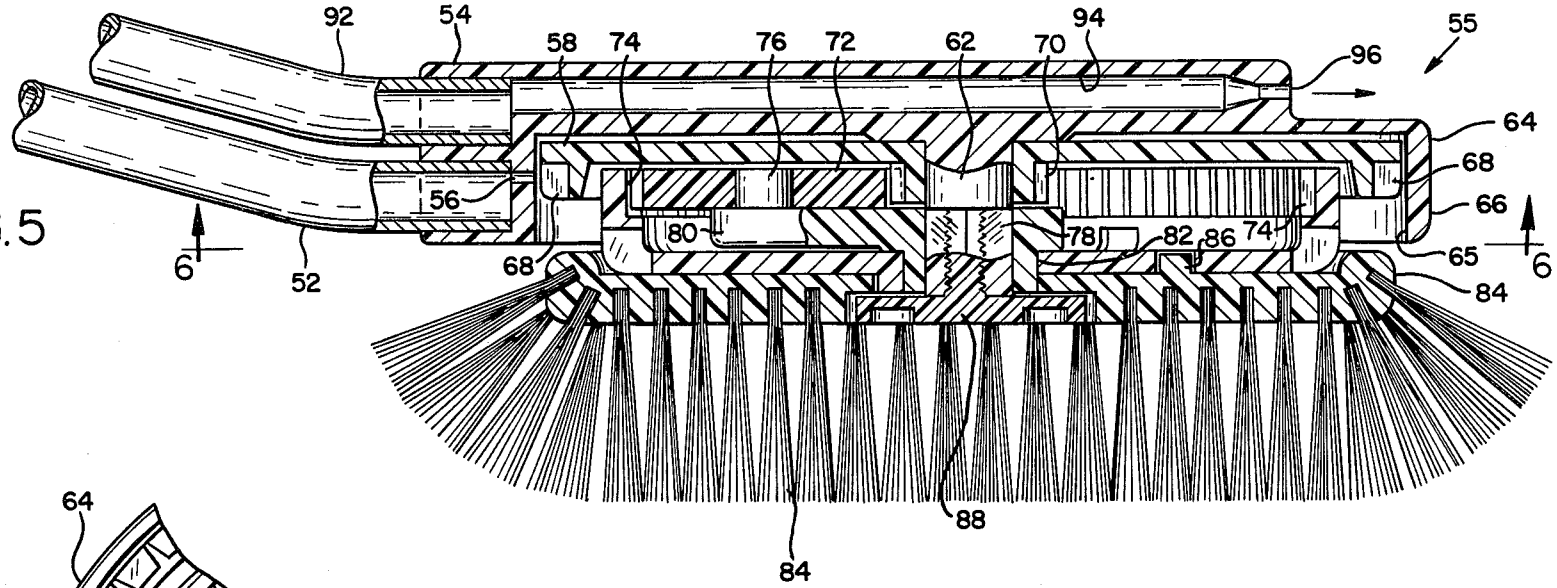
FIG. 5 is a vertical section view of the wash brush head taken on Line 5—5 of FIG. 1.
Figure 4:
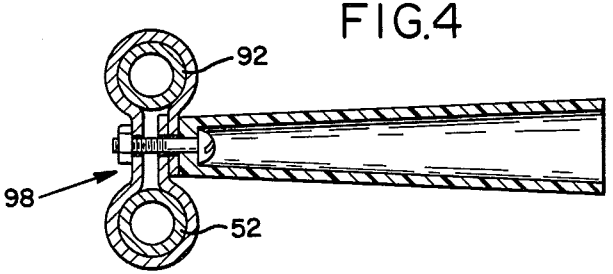
FIG. 4 is a vertical section view of the guide handle taken on Line 4—4 of FIG. 1.
Figure 6:
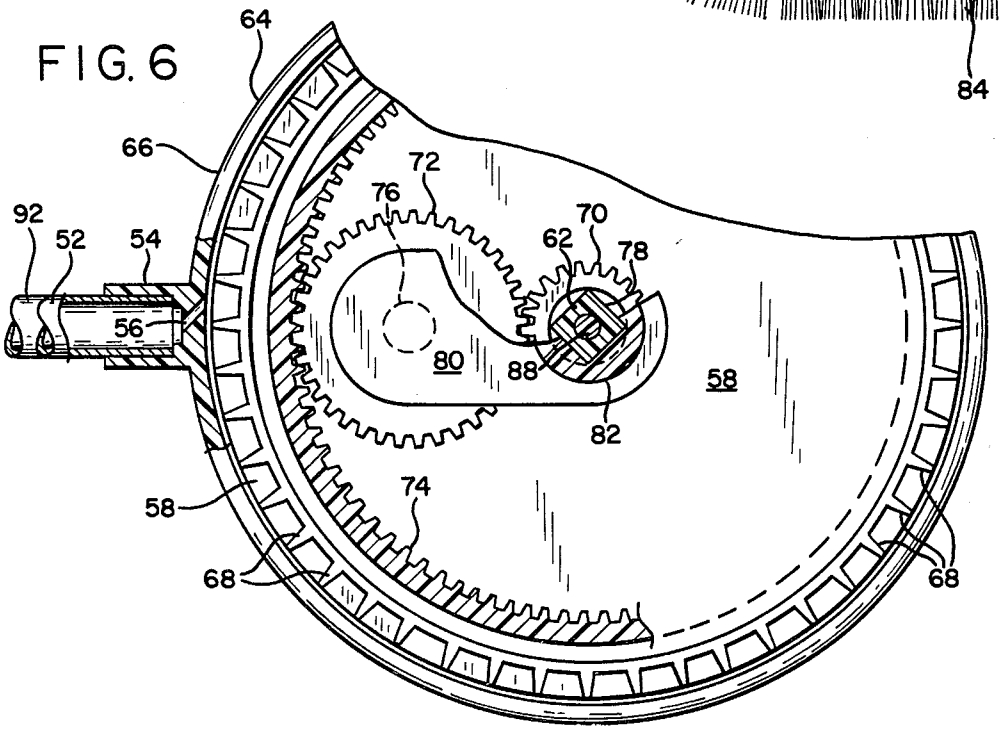
FIG. 6 is a horizontal section view of the brush head showing the planetary gear drive taken on Line 6—6 of FIG. 5.
Figures 7, 8:
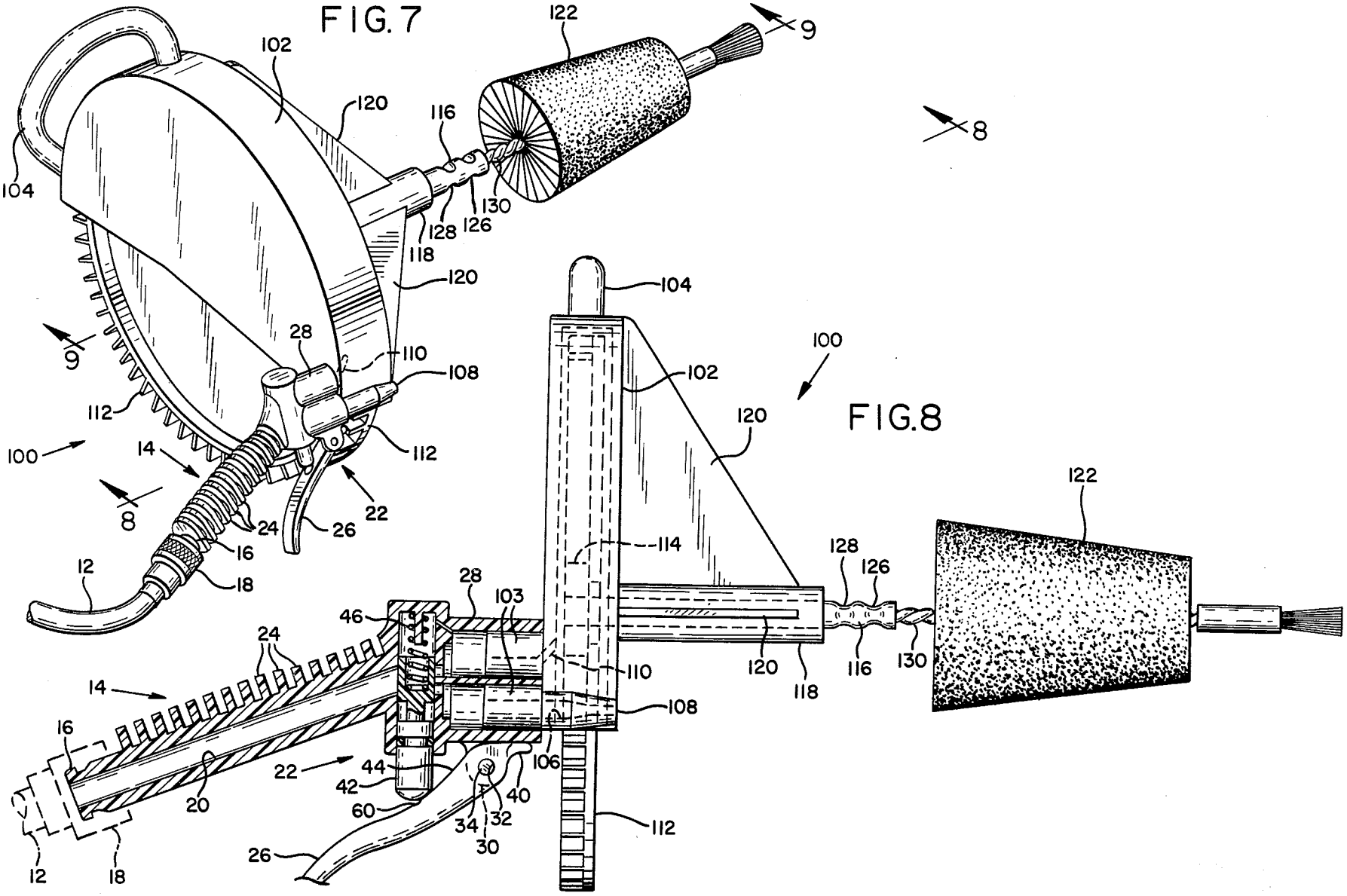
FIG. 7 is a perspective view of the handle/valve assembled to a body and turbine driving a wheel washing brush.
FIG. 8 is a vertical section view of the handle/valve showing the attachment to the wheel washing brush, taken on Line 8—8 of FIG. 7.

It is also noted that each of the orifices 56 in FIG. 5, and 110 in FIG. 7 are calibrated to only allow a small amount of high pressure water, thereby conserving water.

The third device 200 (See FIG. 11) attached to a hose 12 by a quick connect/disconnect shut-off assembly 18 and using the same handle 14 and valve 22 is made to effectively clean or sweep surfaces, such as driveways. Depression of lever 26 allows pressurized water first to be directed to tube 202 and charge nozzle 204, which has a flat, broad pattern 206. The secondary valve position will direct pressurized water through tube 208 to charge nozzle 210, which has a high pressure round squirt pattern 212 for dislodging and moving large objects which the flat pattern 206 is not capable of moving. A caster-type wheel 214 mounted on clamp 216 allows the nozzles 204 and 210 to be directed at a very low controlled attitude toward the surface being cleaned.

What is claimed is:

1. A handle/valve mechanism comprised of a handle with an end of a quick connect/disconnect hose fitting formed at the inlet end, which allows for the passage of pressurized water through a central bore in said handle to a lever operated, single spool, four way control valve formed within said handle, said valve directing flow to a pair of outlet passage orifices used individually or collectively at operator's will to perform a desired operation, one position of said valve channeling water to a first tube which contains as in-line soap dispenser for the purpose of dispensing a small amount of soap into said tube and which is discharged onto a rotating brush after driving a turbine rotatively connected through a planetary gear means to impart rotational motion to said brush during current wash operation; a second position of said valve directing the passage of water through a second tube to an orifice located in the brush body to accommodate rinsing.

2. A rotary cleaning brush device comprised of a handle containing a control valve through which pressurized water controllably flows into a pair of transfer tubes which are each assigned a respective duty through position of said control valve, the first tube directing said pressurized water through an in-line soap dispenser to a disc like rotary brush mechanism having an inverted cup like body, open on its bottom and containing a peripheral guard creating an interior cavity which houses a turbine driven planetary gear reduction apparatus which is driven by high speed water discharged through an orifice in said body located in close proximity to said turbine and angularly directed through said orifice to rotate said turbine, a pinion gear centrally attached to said turbine, said pinion gear being in constant mesh with a planetary gear rotatably mounted on an arm anchored to a squared central post, said planetary gear also being in constant mesh with a ring gear in turn rotating an attached scrubbing brush at a reduced speed for increased power, said in-line soap dispenser being mounted at an intermediate point in said first tube to admit soap in the pressurized water to facilitate cleaning action of said brush, and said device also including means by which said control valve allows pressurized water to be directed to a nozzle, located on top of said cup-like body, to rinse soap residue from the object being cleaned.

3. A water powered cleaning brush device including an inverted cup-like body, open on its bottom and having connected at one side between the top and bottom thereof a combination inflow tube for water and a handle, with a discharge port into the top of said body, said inflow tube having an in-line soap dispenser with said handle at its inlet end, said handle having means for connection to a common garden hose, as well as an integral lever operated, single spool, control valve, said valve directing flow to either one or both of a pair of passage orifices at operator's will to perform a desired operation, an impeller in the top of said body, opposite said discharge port, whereby water discharged through said port drives said impeller, a downwardly depending central fixed round shaft member in said body, said impeller being rotatably mounted thereon, a sun gear centrally attached to said impeller, said sun gear being in constant mesh with a planetary gear rotatably mounted on an anchored post, said anchor mounted on said shaft under said rotor, said shaft being squared preventing anchor rotation, said planetary gear also being in constant mesh with a ring gear rotatably mounted on said anchor, said ring gear in turn rotating a cleaning brush attached thereto at a reduced speed for increased power, and said device also including means by which said control valve allows pressurized water to be directed through a second inflow tube to the top of said body to discharge through a nozzle in said body for finsing purposes, one of said valve passage orifices directing said flow of water into said first mentioned inflow tube and the other said valve passage orifice directing said flow of water into said second inflow tube.

4. A handle/valve mechanism for a cleaning device comprising a tubular handle having connecting means at one end thereof for a water supply hose, a valve body on the opposite end of said handle, a valve spool bore in said body extending transversely of said handle, a pair of parallel discharge bores in said valve body extending in a direction away from said handle, a first discharge orifice in said valve spool bore communicating with one of said discharge bores, a second discharge orifice in said valve spool bore communicating with the other discharge bore, a bore in said handle communicating with said valve spool bore, a valve spool slidable in said valve spool bore, an actuating lever pivotally mounted an said valve body and extending along said handle at a distance therefrom for engagement with an exposed end of said valve spool at one end of said valve spool bore, and a compression spring in the opposite end of said valve spool bore pushing said exposed end of said valve spool into said engagement with said actuating lever to normally close communication between said handle bore and said valve spool bore and close said discharge orifices, said actuating lever and valve spool having a first range of movement when said lever is squeezed toward said handle to open said first discharge orifice, a second range of movement to open both of said discharge orifices, and a third range of movement to close said first orifice and keep open the second orifice, said valve spool maintaining communication with said handle bore throughout said three ranges of movement, a turbine-driven rotary wash brush, a pair of rigid tubes supporting a housing for said brush from said handle, said rigid tubes communicating with said discharge bores, respectively, in said valve body, one of said tubes supplying water to rotate said turbine and supply wash water to said brush and the other tube supplying water to a rinse nozzle on said brush housing.

5. A mechanism as defined in claim 4, said one tube including an in-line soap dispenser.

6. A mechanism as defined in claim 4 including a second handle mounted on said rigid tubes.

7. A washing device comprising a tubular handle having connecting means at one end thereof for a water supply hose, a valve body on the opposite end of said handle, a valve spool bore in said body extending transversely of said handle, a pair of parallel discharge bores in said valve body extending in a direction away from said handle, a first discharge orifice in said valve spool bore communicating with one of said discharge bores, a second discharge orifice in said valve spool bore communicating with the other discharge bore, a bore in said handle communicating with said valve spool bore, a valve spool slidable in said valve spool bore, an actuating lever pivotally mounted on said valve body and extending along said handle at a distance therefrom for engagement with an exposed end of said valve spool at one end of said valve spool bore, and a compression spring in the opposite end of said valve spool bore pushing said exposed end of said valve spool into said engagement with said actuating lever to normally close communication between said handle bore and said valve spool bore and close said discharge orifices, said actuating lever and valve spool having a first range of movement when said lever is squeezed toward said handle to open said first discharge orifice, a second range of movement to open both of said discharge orifices, and a third range of movement to close said first orifice and keep open the second orifice, said valve spool maintaining communication with said handle bore throughout said three ranges of movement, a washing head supported by a pair of parallel tubes mounted in said discharge bores in said valve body for manipulation by said handle, and a nozzle in said washing head supplied by one of said tubes under the control of said actuating lever, the other tube supplying water to said washing head also under the control of said actuating lever.

8. A washing device as defined in claim 7 including a turbine-driven rotary wash brush in said washing head driven by water from said other tube.

9. A washing device as defined in claim 7, said washing head having a pair of nozzles supplied by said pair of tubes, one of said nozzles discharging a cylindrical stream of water and the other nozzle discharging a fan-shaped spray of water.

10. A washing device as defined in claim 9 including a center wheel mounted on said washing head.

* * * * *

UNITED STATES PATENT AND TRADEMARK OFFICE

CERTIFICATE OF CORRECTION

PATENT NO. : 4,461,052

DATED : July 24, 1984

INVENTOR(S) : Thomas A. Mostul

It is certified that error appears in the above-identified patent and that said Letters Patent are hereby corrected as shown below:

Column 5, line 29 (claim 3) "finsing" should read -- rinsing --.

Column 6, line 59 (claim 10) "center" should read --caster--.

Signed and Sealed this

*Twenty-seventh* Day of *November 1984*

[SEAL]

*Attest:*

GERALD J. MOSSINGHOFF

*Attesting Officer*

*Commissioner of Patents and Trademarks*